US005728049A

United States Patent [19]

Alberts

[11] Patent Number: 5,728,049

[45] Date of Patent: Mar. 17, 1998

[54] THERAPEUTIC SEATING APPARATUS

[76] Inventor: Susan Alberts, 200 Dempster St., Evanston, Ill. 60202

[21] Appl. No.: 677,465

[22] Filed: Jul. 10, 1996

[51] Int. Cl.[6] ..... A61H 1/00

[52] U.S. Cl. ..... 601/24; 601/23; 482/131; 482/142; 297/314

[58] Field of Search ..... 482/51, 131, 142, 482/146, 147; 601/5, 23, 24, 26, 86, 90, 98; 297/311, 314, 325; 248/181.1, 182.1, 288.31; 472/31, 35, 47, 135

[56] References Cited

U.S. PATENT DOCUMENTS

| | | | |
|---|---|---|---|
| 30,706 | 11/1860 | Van Vleck | 297/314 |
| 144,441 | 11/1873 | Cartwright | 297/314 |
| 164,240 | 6/1875 | Wertheim . | |
| 249,529 | 11/1881 | Jarvis . | |
| 478,166 | 7/1892 | Madsen | 482/146 |
| 635,234 | 10/1899 | Chance . | |
| 685,419 | 10/1901 | Beattie . | |
| 750,577 | 1/1904 | Bostwick . | |
| 1,283,210 | 10/1918 | Kinney | 601/24 |
| 2,808,828 | 10/1957 | Rubin | 601/5 |
| 2,850,077 | 9/1958 | Dawson . | |
| 3,103,356 | 9/1963 | Heines . | |
| 3,326,209 | 6/1967 | Mandl | 601/86 |
| 3,580,634 | 5/1971 | Bock . | |
| 3,824,991 | 7/1974 | Whitaker | 601/26 |
| 4,130,263 | 12/1978 | Roericht . | |
| 4,659,053 | 4/1987 | Holley et al. | 248/181.1 |
| 4,738,487 | 4/1988 | Shalinsky et al. . | |
| 4,936,629 | 6/1990 | Young . | |
| 4,971,392 | 11/1990 | Young . | |
| 5,029,795 | 7/1991 | Dexter | 248/181.1 |
| 5,048,893 | 9/1991 | Cowan et al. . | |

FOREIGN PATENT DOCUMENTS

| | | | |
|---|---|---|---|
| 2410486 | 6/1979 | France | 482/146 |
| 1370 | of 1914 | United Kingdom | 601/86 |

*Primary Examiner*—Jeanne M. Clark
*Attorney, Agent, or Firm*—Lockwood, Alex, Fitzgibbon & Cummings

[57] ABSTRACT

A seating apparatus is provided which has a seating surface that tilts in a full-circle manner, the tilting being controlled so as to be adequate to allow the person seated on the apparatus to change the alignment of body muscles and skeletal members, while avoiding a degree of movement which would be excessive, potentially uncomfortable and/or possibly disruptive. The apparatus can incorporate a ball-and-socket arrangement which provides for the full circle tilting while also incorporating an appropriate stop surface for preventing excessive tilting along the full-circle rotation orientations. When used for extended periods of time, the seating apparatus improves, rather than detrimentally affects, muscle tone and flexibility, while also reducing risk of back injury and muscle stiffness due to prolonged sitting.

20 Claims, 2 Drawing Sheets

THERAPEUTIC SEATING APPARATUS

BACKGROUND AND DESCRIPTION OF THE INVENTION

This invention generally relates to seating devices having therapeutic properties. More particularly, the invention relates to seating devices which have a seating surface that will move through a large number of positions, including those which are skewed from horizontal along a full circle of rotation, thereby effecting a change in alignment from time to time in order to achieve skeletal movement that takes the pressure off the body, especially the back, of the person using the chair, even for hours at a time. In a specific embodiment, the therapeutic seating device incorporates a mounting assembly which can be characterized as exhibiting a so-called ball-and-socket operation.

In the past, various approaches have been taken in order to provide chairs and the like which have so-called ergonomic qualities. Ergonomic chairs and the like have the objective of decreasing the potential for short-term negative effects on the body of the user. For example, it has been recognized that ergonomic benefits can be realized by having work station chairs which can shift in response to different positions of a person working at such a work station. Typical work stations include desks, computer terminals, factory work stations, and the like.

As an example, U.S. Pat. No. 4,738,487 describes a tilting seat arrangement. This tilting seat tilts about an axis such that the user can tilt the seat forwardly when in a working position, thereby providing lumbar support and combatting hunching of the back and subsequent loss of lordosis, which is the maintenance of a minimum curve in the lower spine. Seat tilting is along horizontal pivot shafts, the emphasis being on providing for forwardly inclined seating to compensate for necessary movement toward a work surface.

Prior art such as U.S. Pat. No. 5,048,893 relate to chairs having ergonomic properties so that the user can accommodate a range of postural adjustments such as from a slightly rearward reclined, rest position through to a forward hunched, task position. This approach is said to provide the advantage of having the seat change its attitude as a result of differing thigh angles which vary as the user assumes different positions, such as between the aforementioned rest position and task position. This ergonomic chair can include seat components which travel in a concave arc.

So-called ergonomic approaches such as these fall short of providing a wide enough range of movement of the seating surface that will have therapeutic benefits by allowing for an effectively infinite number of different positions thereby allowing the body of the user to move in patterns which are not necessarily repetitive or significantly limited in orientation. It has been found that, by providing this wide range of movement and orientation which is possible in accordance with the present invention, therapeutic benefits are realized such as improved muscle tone and muscle flexibility.

In summary, the present invention is directed to a seating apparatus such as a chair which accomplishes therapeutic benefits. In an important aspect of the invention, the seating surface is multi-attitudinal in that it will assume a virtually limitless number of attitudes or orientations, such as with respect to a purely horizontal orientation. This multi-attitudinal characteristic can be described as encompassing tilting through a full 360° of movement. The therapeutic seating apparatus according to the invention includes a support assembly which engages the ground or flooring and which provides support for the seating assembly which includes the surface upon which a person will sit. The seating assembly and support assembly are in engagement with each other at opposing respective 3-dimensional curved surfaces of the support assembly and of the seating assembly. In a preferred arrangement, these surfaces operate in the nature of a ball-and-socket structure. The person using the seating device will, by weight shifting while seated, vary the attitudes and movement of the person's skeletal network, this movement being allowed by the full-rotation tilting of the seating component.

It is accordingly a general object of the present invention to provide an improved therapeutic seating apparatus.

Another object of the present invention is to provide an improved therapeutic seating apparatus having a seating surface which exhibits full-circle tilting which facilitates changes in skeletal alignment from time to time during extended seated sessions for any variety of activities.

Another object of this invention is to provide an improved seating apparatus having a seating surface which can spin and move at any angle through a limited range of movement.

Another object of the present invention is to provide an improved therapeutic seating apparatus which permits and encourages changes in skeletal positioning by having a seat which rotates slightly at every angle in order to impart movement to the largest muscles and alleviate pressure from the back and spine.

Another object of the present invention is to provide an improved therapeutic chair which allows the user's body to shift and thereby make small adjustments in the angle of the seat.

Another object of the present invention is to provide an improved therapeutic seating device which improves muscle tone and flexibility during seated activities, achieving a reduction in the risk of back injury and reduced muscle stiffness which could otherwise develop during extended periods of seated activities.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DETAILED DESCRIPTION OF THE INVENTION

Figure 3:
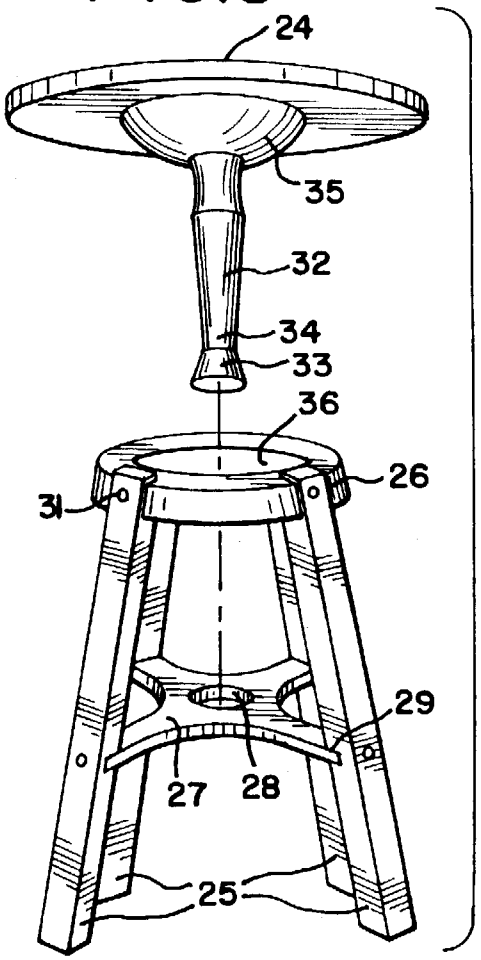
FIG. 3 is an exploded perspective view of the device illustrated in FIG. 1.
Figure 2:
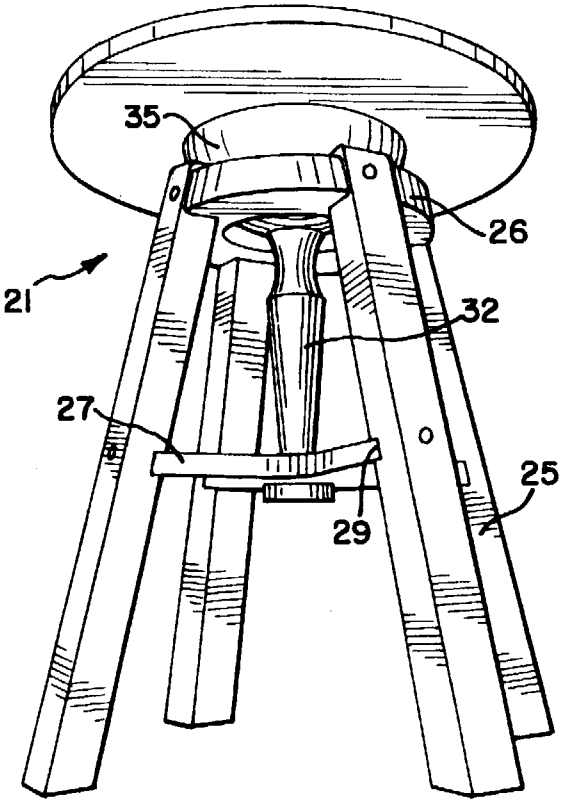
FIG. 2 is another perspective view of the seating apparatus shown in FIG. 1, the perspective being from a somewhat underside angle.
Figure 1:
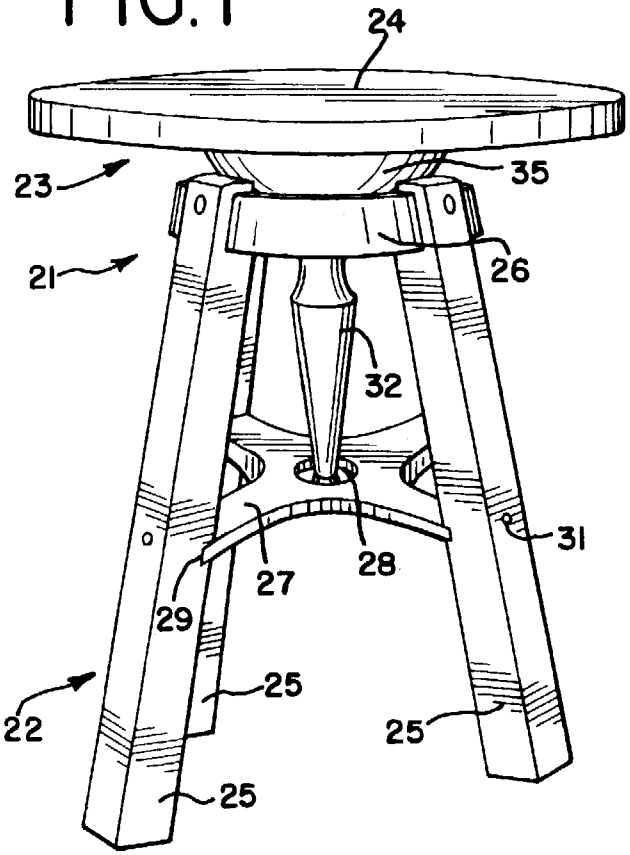
FIG. 1 is a perspective view of a preferred embodiment of the present invention.

A therapeutic seating apparatus in accordance with the present invention, generally designated as 21, is illustrated in FIG. 1. Included is a support assembly, generally designated as 22. Mounted to this support assembly is a seating assembly, which is generally designated as 23. Seating assembly 23 is in operative engagement with the support assembly 22 in a manner which allows for full-circle tilting movement of a seating surface 24. It will, of course, be appreciated that the user of the therapeutic seating apparatus sits upon the seating surface 24 when this apparatus is in use.

With more particular reference to the support assembly 22 which is shown in FIGS. 1, 2, 3 and 4, this assembly includes a plurality of legs 25 which engage the ground in typical fashion, it being understood that the ground will usually be a horizontal floor at a work station, in front of desk, a computer terminal or the like. Legs 25 are secured to a platform 26. In this manner, the platform 26 is solidly and securely supported above the ground at a distance which is suitable for seating for the particular task for which the therapeutic seating apparatus is designed.

A holding member 27 is also illustrated as a component of movement-directing components including the support assembly. In this particular embodiment, the holding member 27 functions as a support brace for the legs 25 so as to hold them in their relative set position in accordance with generally customary practice. In addition, this holding member 27 provides an important function in the operation of the therapeutic seating apparatus, as is described in more detail hereinbelow. In this regard, it will be noted that the holding member 27 includes a generally centrally located opening or passageway 28 which interacts with a component of the seating assembly 23. The various components of the apparatus can be joined together by suitable arrangements typical of furniture and the like. Such can include grooves 29 and/or dowels, pins or bolts 31, as well as glues and adhesives or the like.

Regarding the seating assembly 23, the seating surface 24 is the uppermost component thereof which is illustrated. It will be appreciated that the seating surface can include other components. For example, a back or arm rests could be included as desired.

Seating assembly 23 includes a stem member 32 which is generally downwardly depending. It rotates through a full circle of 360°. In the illustrated embodiment, this stem member is a swinging member which interacts with the holding member 27. It will be noted that the remote end of the stem member 32 is located within and through the passageway 28 of the holding member. In the illustrated embodiment, this stem member remote end includes an end projection 33. Immediately above this end projection is a necked-down portion 34 which has a perimeter smaller than at least the largest horizontal perimeter of the end projection 33.

A primary sliding engagement surface 35 is positioned between the seating surface 24 and the stem member 32 and/or end projection 33. In the illustrated embodiment, this primary sliding engagement surface 35 is configured as a segment of a sphere. Typically this spherical segment surface will be less than a hemispherical surface, although such a more extensive surface is possible.

It will be noted that the platform 26 has an internal surface 36 and functions in the nature of a socket, support or race. This internal surface is complementary in curvature and size with the primary sliding engagement surface 35 of the seating assembly. This complementary relationship is perhaps most clearly illustrated in FIG. 6. It will be appreciated that the primary sliding engagement surface 35 fits directly within the internal surface 36. Internal surface 36 is thus also a sliding engagement surface. More particularly, the primary sliding engagement surface, and thus the seating assembly 23, will mount within and be in engagement with the internal surface 36 and thus with the support assembly 22. The arcuate sliding interaction between respective surfaces 35 and 36 is in the nature of a ball-and-socket action, which action results in attitudinal movement of the seating surface 24. This multi-attitudinal movement is instituted by forces exerted onto the seating surface 24 by the body, especially the buttocks and thighs, of the person seated on the therapeutic seating apparatus.

Figure 4:
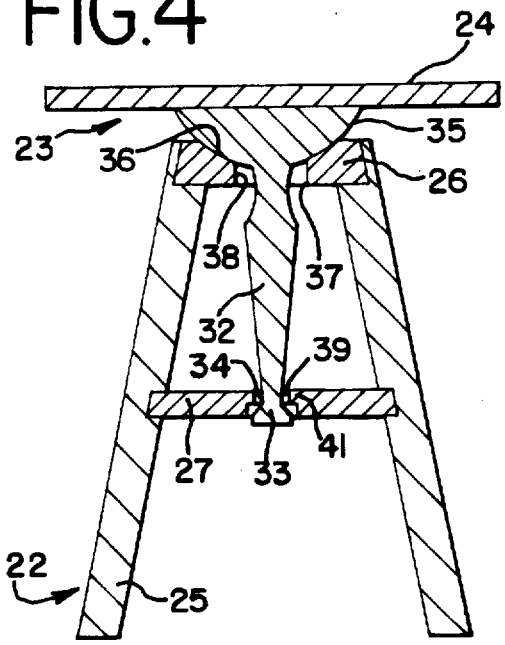
FIG. 4 is a cross-sectional view through the vertical center of FIG. 4.

When the primary sliding engagement surface 35 is a segment of a sphere, the internal sliding engagement surface 36 will correspondingly be a zone of a sphere inasmuch as same will typically require a bottom opening defined by a mouth 37. Spaced inwardly thereof can be a generally annular surface 38 (FIG. 4). Generally speaking, the larger the area of the internal sliding engagement surface 36, the greater is the friction between the respective sliding surfaces 35 and 36. This will affect the general overall operation of the apparatus and can be varied as desired and in view of the materials of these engagement surfaces.

It will be appreciated that, as the seating assembly moves by the sliding engagement between these surfaces 35 and 36, the stem member 32 will move in a generally swinging manner. In order to accommodate this movement, an annular clearance 39 is provided between the holding member 27 and the stem member 32. In the illustrated embodiment, this clearance is between the necked-down portion 34 and the passageway 28. In addition, the passageway 28 preferably includes a narrowed opening 41. This serves as a stop member in order to maintain the stem member and thus the seating assembly 23 secured down onto the support assembly 22. Thus, this narrowed opening 41 engages the end projection 33 of the stem member so as to avoid excessive upward movement of the stem member and thus of the seating assembly.

Figure 5:
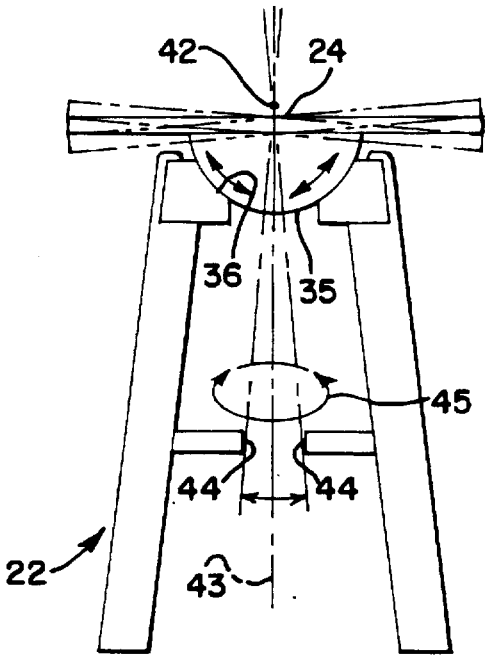
FIG. 5 is a schematic illustration of full circle tilting according to the invention.

Turning now to FIG. 5, important operational aspects of the invention are illustrated. In this illustration, the primary sliding engagement surface 35 is a segment of a sphere having a spherical center 42, although its working surface is only a zone of a sphere. It will be observed that, in this illustration, the spherical center is a virtual spherical center inasmuch as same does not lie within the device. Instead, it is spaced somewhat above the seating surface 24. This spherical center serves as a 3-dimensional pivot point about which the "ball" having the primary sliding engagement surface 35 rotates. This 3-dimensional pivot point 42 lies along a generally vertical axis 43, in this case an axis which is central with respect to the seating assembly, and particularly the primary sliding engagement surface 35.

Illustrated internal engagement surface 36 of the illustrated movement-directing assembly also has a central vertical axis, and it substantially coincides with the illustrated axis 43. Primary sliding engagement surface 35 is thus free to rotate within the internal sphere zone surface 36. Each radius of such rotation will substantially pass through the 3-dimensional pivot point 42. This is true whether the pivot point is within a component of the seating assembly or whether it is a virtual pivot point as illustrated in FIG. 5.

In two dimensions, this sliding rotational action between the respective surfaces 35 and 36 results in the tilting of the seating surface 24. This tilting is generally illustrated in phantom in FIG. 5. This is also illustrated by the arrowhead pairs depicted along these rotationally engaging surfaces 35 and 36. Although not explicitly shown in FIG. 5, it will be appreciated that a stem member or the like downwardly depends from the primary surface 35. As previously discussed, this member will be able to move through a clearance 39. This movement is limited by the stop surface 44, which will typically be an annular surface. The range of movement, again as illustrated in two dimensions, is depicted in FIG. 5 by the double-arrowhead which spans the stop surface 44. In this manner, the range of tilting is limited so as to avoid excessive tilting which could be counterproductive to the objective of properly exercising muscle groups and skeletal components.

Figure 6:
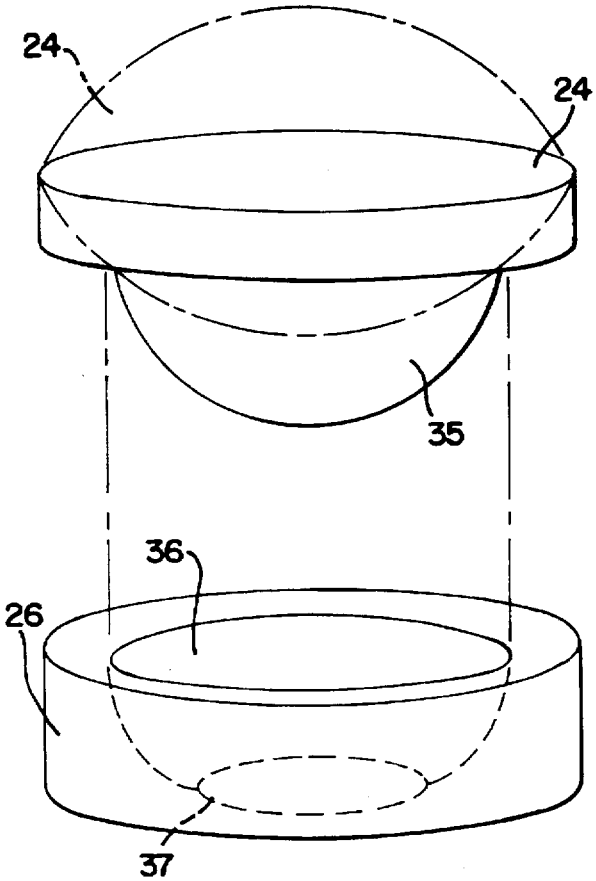
FIG. 6 is a detailed illustration, in exploded perspective, of a preferred mounting arrangement for imparting full circle tilting capabilities to the present invention.

FIG. 5 also provides a rough illustration of the 3-dimensional action according to the present invention. Arrowhead circle 45 illustrates this range of movement in a full-circle context. Also, FIG. 6 shows (in phantom) the seating surface 24 tilted with an orientation that is rotated 90° from that shown in phantom in FIG. 5. It will be appreciated that virtually an infinite number of such tilting orientations are possible. Furthermore, it will be appreciated that the amount of tilting is variable between horizontal and the limits provided by the stop surface 44. The result is full circle tilting which will vary with the amount of force applied by the user's body, primarily the user's buttocks, thighs and back, onto the seating surface 24, as well as the angle or orientation at which that force is applied onto the seating surface (and/or back surface when provided).

Figure 7:
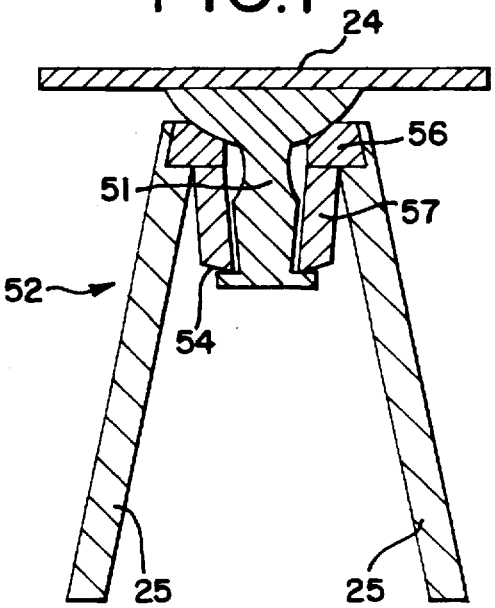
FIG. 7 is a cross-sectional view similar to FIG. 4, illustrating an alternative embodiment of the invention.

FIG. 7 illustrates an alternate embodiment. In this arrangement, the supporting assembly, generally designated as 52, takes on a form different from the support assembly 22. In this arrangement, a holding member 57 is secured to the platform 56, rather than to the legs 25. Holding member 57 could take the form of a truncated cone or a plurality of generally downwardly directed rigid members. The holding member 57 includes a stop surface 54 for engaging and holding down a stem or swinging member 51 of the seating assembly. In the illustrated arrangement, this holding feature includes engagement between the stop surface 54 and an end projection 53 of the stem member.

It will be appreciated that other variations are possible. These include supporting assemblies which are secured to both the platform and the legs. Other options include the addition of a back and/or arm rests or other seating surface features, such as seating surfaces which are contoured rather than flat as shown.

It will be understood that the embodiments of the present invention which have been described are illustrative of some of the applications of the principles of the present invention. Numerous other modifications may be made by those skilled in the art without departing from the true spirit and scope of the invention.

I claim:

1. A therapeutic seating apparatus, comprising:

a ground-engaging support assembly having an axis which is substantially vertical;

a seating assembly having a swinging member which is downwardly disposed on the seating assembly, said seating assembly being in operative, supported engagement with said ground-engaging support assembly, said seating assembly including a seating surface for receiving a user of the therapeutic seating apparatus, said seating surface having a plurality of positions including a generally horizontal position;

said seating assembly has a generally vertical axis which substantially coincides with said vertical axis of the ground-engaging support assembly during at least one of said plurality of positions of the seating surface, said generally vertical axis of the seating assembly passing through a pivot location;

said downwardly disposed swinging member generally lies along said generally vertical axis of the seating assembly;

movement-directing components of said support assembly and of said seating assembly, said movement-directing components including opposing curved surfaces which are in sliding engagement with each other, one of said curved surfaces being a component of the seating assembly, while another of said curved surfaces is a component of said support assembly, said movement-directing components allowing for movement between said opposing curved surfaces such that said generally vertical axis of the seating assembly, while this vertical axis continues to pass through said pivot location, is movable to any location within a frustum of a cone; and said movement-directing components include a holding member which restricts movement of said downwardly disposed swinging member of the seating assembly, thereby defining a maximum radius of said frustum of a cone at said holding member, and wherein said holding member is secured to said support assembly.

2. The therapeutic seating apparatus in accordance with claim 1, wherein said movement-directing components allow for tilting of said seating surface through a full circle of tilting orientations.

3. The therapeutic seating apparatus in accordance with claim 1, wherein said movement-directing components include a ball-and-socket assembly in which a ball component thereof is included in said seating assembly and wherein a socket component thereof is included in the support assembly.

4. The therapeutic seating apparatus in accordance with claim 1, wherein said respective curved surfaces of the seating assembly and of the support assembly are zones of a sphere.

5. The therapeutic seating apparatus in accordance with claim 1, wherein said downwardly disposed swinging member is a stem member.

6. The therapeutic seating apparatus in accordance with claim 5, wherein said stem member includes a protruding end projection adjacent to a necked-down portion of the stem member.

7. The therapeutic seating apparatus in accordance with claim 6, wherein said holding member includes a narrowed opening through which said necked-down portion passes and a downwardly-facing surface which engages said end projection of the stem member, further including an annular clearance between said necked-down portion and said narrow opening.

8. The therapeutic seating apparatus in accordance with claim 5, wherein said stem member includes a surface which has a reducing taper in the downward direction.

9. The therapeutic seating apparatus in accordance with claim 1, wherein said support assembly includes a platform, and said holding member is secured to said platform and includes a stop surface which engages a portion of said downwardly disposed swinging member to prevent substantial generally upward movement of the swinging member and of the seating assembly.

10. The therapeutic seating apparatus in accordance with claim 1, wherein said pivot location is remote from said therapeutic seating apparatus itself.

11. The therapeutic seating apparatus in accordance with claim 1, wherein said generally vertical axis of the seating assembly is a central longitudinal axis, and wherein said pivot location is above said seating surface.

12. The therapeutic chair in accordance with claim 1, wherein said swinging member has an end portion, said holding member includes an opening through which said end portion of the swinging member passes, said holding member includes a downwardly-facing surface which engages said end portion of said swinging member, and said holding member further includes an annular clearance between said end portion and said opening.

13. The therapeutic chair in accordance with claim 12, wherein said holding member includes a stop surface which engages said end portion of said swinging member to prevent substantial generally upward movement of the swinging member and of the seating assembly.

14. The therapeutic chair in accordance with claim 12, wherein said support assembly includes a platform, and said holding member is secured to said platform, and includes a stop surface which engages a portion of said downwardly disposed swinging member to prevent substantial generally upward movement of the swinging member and of the seating assembly.

15. A therapeutic chair, comprising:

a seating assembly including a seating surface for supporting the weight of a user of the therapeutic chair, said seating surface having a plurality of positions including a generally horizontal position;

a ground-engaging support assembly which operatively supports said seating assembly;

said support assembly and said seating assembly include movement-directing components, one of said movement-directing components being a 3-dimensionally curved surface of said seating assembly, another of said movement directing components being a 3-dimensionally curved surface of said support assembly, and said respective 3-dimensionally curved surfaces are complementary with each other and are in sliding engagement with each other;

said movement-directing components provide for tilting of said seating surface through a full circle of tilting angles and orientations which include said generally horizontal position of the seating surface;

said seating assembly further having a swinging member which is downwardly disposed from the seating assembly, and said swinging member includes a protruding end projection adjacent to a necked-down portion of the swinging member; and said movement-directing components further include a holding member which restricts movement of said swinging member of the seating assembly.

16. The therapeutic chair in accordance with claim 15, wherein said movement-directing components include a ball-and-socket assembly in which a ball component thereof is included in said seating assembly and wherein a socket component thereof is included in said support assembly.

17. The therapeutic chair in accordance with claim 15, wherein said curved surface of the seating assembly and said curved surface of the support assembly are each a zone of a sphere.

18. The therapeutic chair in accordance with claim 15, wherein said holding member includes a narrowed opening through which said necked-down portion passes and a downwardly-facing surface which engages said end projection of the swinging member, further including an annular clearance between said necked-down portion and said narrow opening.

19. The therapeutic chair in accordance with claim 15, wherein said swinging member includes a surface which has a reducing taper in the downward direction.

20. A therapeutic seating apparatus, comprising:

a ground-engaging support assembly having legs and an axis which is substantially vertical;

a seating assembly which is in operative, supported engagement with said ground-engaging support assembly, said seating assembly including a seating surface for receiving a user of the therapeutic seating apparatus, said seating surface having a plurality of positions including a generally horizontal position;

said seating assembly has a generally vertical axis which substantially coincides with said vertical axis of the ground-engaging support assembly during at least one of said plurality of positions of the seating surface, said generally vertical axis of the seating assembly passing through a pivot location;

said seating assembly has a swinging member;

movement-directing components of said support assembly and of said seating assembly, said movement-directing components allowing for movement of said seating surface such that said generally vertical axis of the seating assembly, while this vertical axis continues to pass through said pivot location, is movable to any location within a frustum of a cone;

said movement-directing components include opposing curved surfaces which are in sliding engagement with each other, one of said curved surfaces being a component of the seating assembly, while another of said curved surfaces is a component of said support assembly;

said movement-directing components include a holding member which restricts movement of said swinging member of the seating assembly, thereby defining a maximum radius of said frustum of a cone at said holding member;

said swinging member is a stem member which is downwardly disposed on the seating assembly and which generally lies along said generally vertical axis of the seating assembly; and said holding member is secured to said legs of said support assembly and includes a stop surface which engages a portion of said stem member to prevent substantial generally upward movement of the stem member and of the seating assembly.

* * * * *